US005354066A

United States Patent [19]

Swanson et al.

[11] Patent Number: 5,354,066

[45] Date of Patent: Oct. 11, 1994

[54] PROJECTILE TARGET

[76] Inventors: Dale A. Swanson, 6106 Birch Rd., Prior Lake, Minn. 55372; Mark A. Solberg, 4051 Glacier La., Plymouth, Minn. 55446

[21] Appl. No.: 170,711

[22] Filed: Dec. 21, 1993

[51] Int. Cl.[5] ..... F41J 3/00

[52] U.S. Cl. ..... 273/408

[58] Field of Search ..... 273/408, 403, 404, 407, 273/409

[56] References Cited

U.S. PATENT DOCUMENTS

| | | | |
|---|---|---|---|
| 932,352 | 8/1909 | Sullivan . | |
| 1,837,627 | 12/1931 | Mead et al. | 273/403 |
| 3,048,401 | 8/1962 | Dishon | 273/403 X |
| 3,088,738 | 5/1963 | Meyer | 273/407 X |
| 3,203,698 | 8/1965 | Saunders | 273/404 |
| 3,367,660 | 2/1968 | Di Maggio | 273/404 |
| 3,476,390 | 11/1969 | Roloff et al. | 273/404 |
| 3,762,709 | 10/1973 | Roloff et al. | 273/404 |
| 3,900,778 | 8/1975 | Bruner . | |
| 4,076,246 | 2/1978 | Meyer . | |
| 4,235,444 | 11/1980 | Meyer | 273–403 |
| 4,244,585 | 1/1981 | Croll | 273/408 |
| 4,294,452 | 10/1981 | Schlotter et al. | 273–403 |
| 4,456,264 | 6/1984 | Dotwiler | 273/404 |
| 4,546,984 | 10/1985 | Towle et al. | 273/408 X |
| 4,643,434 | 2/1987 | Carlin | 273–408 |
| 4,695,060 | 9/1987 | Pilgrim | 273/404 |
| 5,002,285 | 3/1991 | Morrell | 273/408 |

FOREIGN PATENT DOCUMENTS

| | | | |
|---|---|---|---|
| 2,932,778 | 3/1981 | Germany | 273–404 |

OTHER PUBLICATIONS

American Excelsior Co. Advertisement Date unknown.

Lighthouse Distributing Inc. Advertisement Date unknown.

McKenzie Natra-look Targets Advertsiement Date unknown.

Morrell Manufacturing Advertisement Date unknown.

Saunders Archery Accessories Advertisement Date unknown.

PPS Advertisement Date unknown.

Southern Archery Advertisement Date unknown.

*Primary Examiner*—William H. Grieb

*Attorney, Agent, or Firm*—Merchant, Gould, Smith, Edell, Welter & Schmidt

[57] ABSTRACT

An archery target is disclosed that is formed from multiple front layers formed from a woven material having laterally displaceable strands to permit penetration of an arrowhead, multiple backing layers formed from material which resists penetration of an arrowhead and a plurality of aligned pockets formed between the front and backing layers. Stuffing material such as raw cotton is compressibly forced into each of the pockets resists lateral displacement of the stuffing material upon penetration of an arrowhead and causes the stuffing material to be compressed in front of the arrowhead to effectively stop the arrow.

23 Claims, 3 Drawing Sheets

PROJECTILE TARGET

BACKGROUND OF THE INVENTION

The invention broadly relates to target apparatus for projectiles, and is specifically directed to an improved archery target.

In recent years archery has become increasingly popular, particularly in connection with competitive target shooting, recreational target shooting and bow hunting. This popularity has been accompanied by significant technological advances with respect to the design, construction and materials for both bows and arrows. Currently, the most advanced high energy bows are capable of shooting carbon/graphite arrows at velocities exceeding 300 feet per second (i.e., approximately 200 miles per hour).

In target or range shooting, at both recreational and competitive levels, technology with regard to the targets themselves has lacked significantly. Arrows shot at very high speeds are capable not only of deeply penetrating the target but also passing entirely through the target thickness; i.e., the entire arrow exits the rear face of the target. This results in rapid breakdown and target disintegration, which occurs primarily because conventional targets are incapable of efficiently stopping high speed arrows. When the arrow penetrates a conventional target, it displaces the inner material of the target laterally; i.e., the arrow moves the material to the side, and the arrow is slowed by friction. When the arrow is removed, it leaves a hole corresponding to the diameter of the arrow. The longevity of the target (i.e., its ability to avoid material breakdown) is a function of the capability of the inner target material to return to its original position, thus closing the hole. Since the inner target material in conventional targets exists in a relatively large mass or volume, the target material is more easily displaced with increasing use and less and less capable of closing the hole created by arrow penetration. Thus, small arrow holes give way to larger and larger holes, ultimately resulting in target breakdown and disintegration.

Since archery targets are relatively expensive to purchase, the cost of maintaining targets at an archery range, whether commercial, competitive or recreational, becomes significant and sometimes prohibitive. Commercial ranges often use primary materials such as excelsior bales, fiberboard or compressed corrugated cardboard rather than manufactured targets. The reason for using primary materials is that they last longer and are more economically purchased than manufactured targets heretofore available. Nevertheless, these primary materials are problematic for a number of reasons.

For example, excelsior bales must be kept moist for maximum effectiveness. The moisture also reduces the likelihood of spontaneous combustion, which is a significant problem with respect to dry excelsior. Several states and municipalities require automatic sprinkling systems if excelsior is used for target material, and others do not permit its use as target material because of the fire hazard.

Further, when a hole develops it is not possible for it to be repaired. This problem is compounded by the fact that arrows are difficult to extract from the material, and damage to the arrow often occurs. Excelsior also leaves refuse as the material disintegrates, and this problem is compounded by the fact that a single archery lane for one shooter requires at least three bales.

Fiberboard is also used in commercial archery ranges in lengths (e.g., 10 feet) that are cut two feet wide and laid flat in stack relation. The height of the stack must be suitable to form a shooting wall, typically four feet to six feet in height. These layers must be compressed, which is accomplished by threaded rods extending through the entire thickness of the stack. Installation takes considerable time and initial cost is relatively expensive.

Fiberboard also disintegrates fairly rapidly after a hole develops, and this also requires some degree of cleanup in the range area. Compressed fiberboard also damages arrows both with penetration and removal.

Compressed corrugated cardboard is installed in substantially the same manner as fiberboard. It also involves relatively significant time, labor and expense in installing a new wall, but has relatively low durability. When a hole develops, a wall section must be replaced to maintain effectiveness. Arrow damage is also a problem with compressed corrugated cardboard.

Aside from primary materials, separate manufactured targets that are currently available also involve various problems.

One type of conventional archery target includes wrapped layers of grass that may be upwards of 12 inches thick and quite heavy. To ensure that such targets will stop most arrows and also to improve longevity, the target is wetted down and maintained in a moist state during use. This results in an extremely heavy target that is not only difficult to move but also cannot be stacked for storage because of the possibility of spontaneous combustion.

Other prior art targets employ a framework of semi-rigid foam that supports a plurality of alternate layers of cotton and different types of materials, including both burlap and synthetic materials. While arrow removal is relatively easy under normal conditions, the use of heavier bows with carbon/graphite arrows with such targets results in pass through in a relatively short amount of time.

Further, the voids created by removed arrows do not disappear, and the cotton filler material tends to settle at the bottom of the target with continued use. This is due both to gravity and the agitation caused by the penetrating arrow shaft. Targets made in this manner are often periodically rotated 90° to compensate for this settling problem.

Our invention is the result of an endeavor to manufacture an improved archery target that will stop arrows quickly and efficiently without deep penetration and which will have a useful life that is significantly longer than prior art targets, thus reducing the overall cost of target maintenance. To accomplish these objectives, a target is provided which utilizes a multiple layer construction in combination with a plurality of compartments or pockets. Based on ease of manufacture, these compartments are aligned or parallel in the preferred embodiment. The compartments define a plurality of relatively small volumes, as distinguished from a single large volume, and each is packed extremely tightly with material so that it is displaced by compression in front of the arrowhead rather than lateral displacement to the side of the arrow. This enables the material to more easily return to its original position after arrow removal (i.e., the arrow hole is more readily closed after arrow removal). The preferred material for the segmented compartments is raw, processed (i.e., ginned) cotton.

The construction of the segmented compartments is such that, when each receives cotton under substantial compression, it expands laterally to the point of engaging the adjacent compartment or compartments. Thus, the target presents a relatively flat face to the arrow, rather than an outwardly bowed face that is common with single compartment targets. Further, the expanded contiguous compartments present a continuous (i.e., ungapped) face, and even if an arrow penetrates the target at a point lying between adjacent compartments, the arrow will nevertheless be stopped efficiently because there is no gap between compartments.

In most prior art targets, the arrow is stopped by friction. By using highly compressed cotton in a plurality of separate compartments, the cotton, which has long inherent fibers, has a tendency to ball up in front of the arrowhead, thus stopping the arrow by compression rather than friction. This not only efficiently stops the arrow, but also enables it to be removed easily. The use of multiple compartments with highly compressed material limits the amount of material that can be laterally displaced or pushed to the side, instead compressing the material in front of the arrowhead for significantly increased stopping power.

In contrast, prior art archery targets which utilize cotton as the filler material rely to some extent on compression to stop the arrow, but because of the large cavity in which the cotton is placed it is impossible to maintain sufficient compression to withstand repeated arrow penetration without sustaining lateral movement of the filler material and decreased effectiveness.

Since arrow stoppage in the improved target is by forward displacement and compression rather than lateral displacement and friction, penetration is at a lesser depth and the resulting arrow hole is filled much more easily after arrow removal. As a result, the target not only efficiently stops high velocity arrows, but also lasts much longer than conventional targets.

The inventive target finds application at the recreational, competitive and commercial level. It is particularly attractive in modern commercial archery range applications because the inventive target does not shed or leak material on to the floor and provides a target backstop that is easily moved from a heavily used shooting lane to a lightly used shooting lane, thus increasing longevity of the entire range. The result is a cleaner range floor and lesser maintenance.

Although the target is described below in relation to archery, the inventive concept can be utilized for other purposes and in connection with different projectiles, such as a backstop or target for the bullets of firearms.

These features and others will be better appreciated from the following description and associated drawings.

DESCRIPTION OF THE PREFERRED EMBODIMENT

Figure 1:
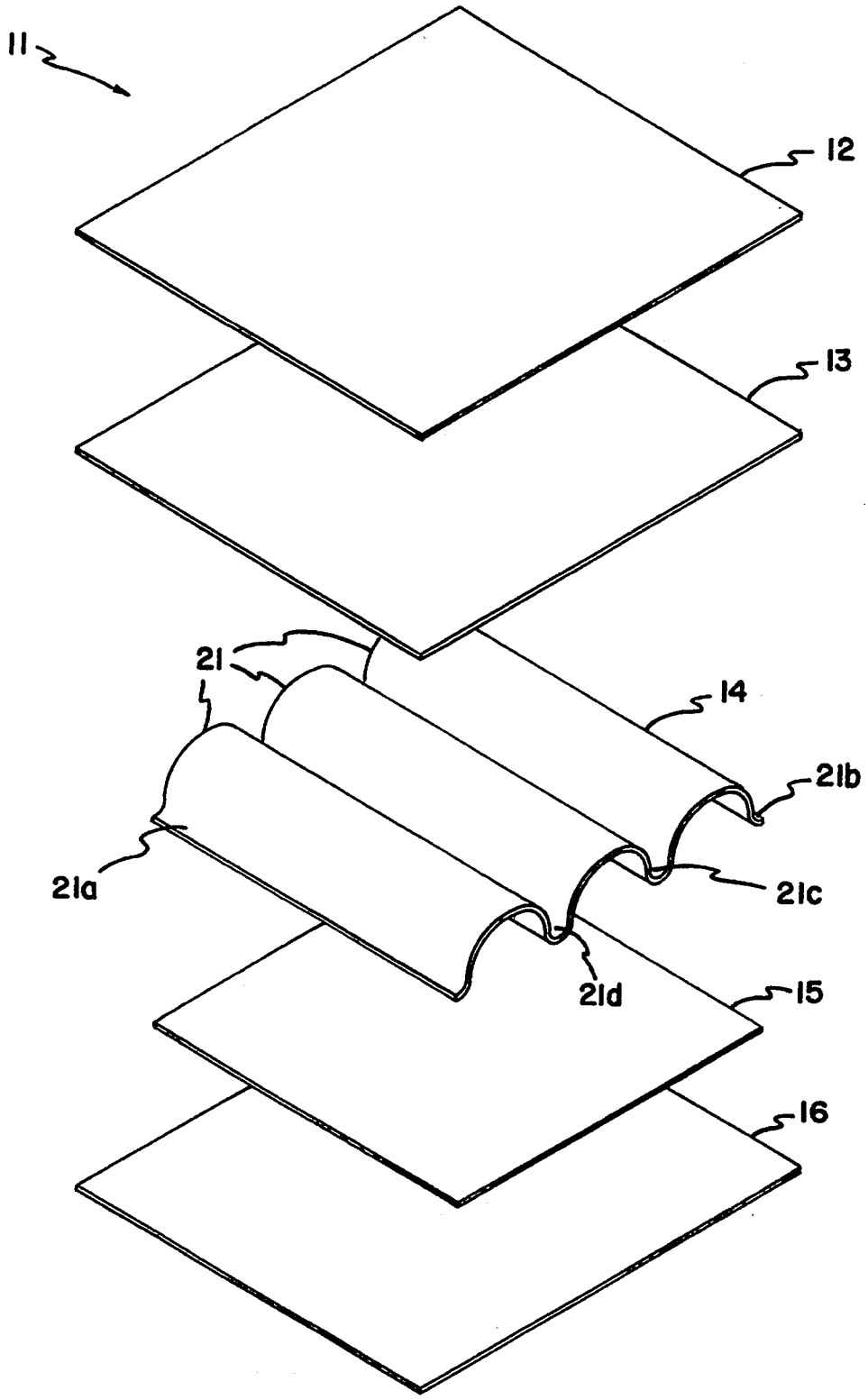
FIG. 1 is an exploded perspective view of certain of the components of an archery target embodying the invention.
Figure 4:
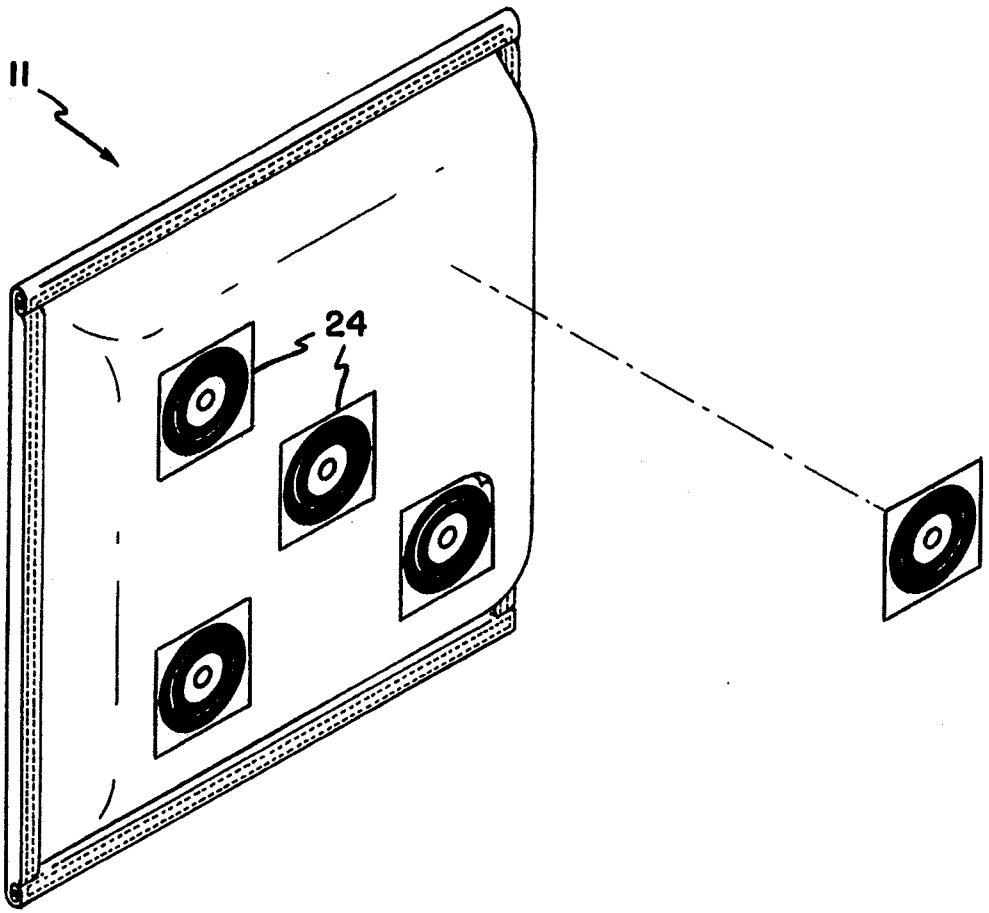
FIG. 4 is a perspective view of the fully assembled archery target.

With initial reference to FIGS. 1 and 4, an archery target embodying the invention bears general reference numeral 11. As particularly shown in FIG. 4, the preferred configuration of target 11 is square or rectangular because such configurations better lend themselves to the structure embodying the invention. However, it is possible to utilize the inventive principles in other configurations, such as circular, although such configurations could be more difficult and/or expensive to manufacture.

With reference to FIG. 1, the preferred embodiment of target 11 comprises five separate layers 12–16, each of which is square or rectangular in form and the dimensions of which define the ultimate size of the target. As discussed in further detail below, the layers 12–16 are not the same size.

Layer 12 represents the front face of the target and is formed from a woven material having strands that are capable of separating at the point of arrow impact, thus enabling the arrow to pass through without strand breakage. Preferably, multiple layers are used with burlap (e.g., 10 ounce burlap) as the preferred material.

Layer 13 is also a woven material having strands that separate to permit the arrow to pass through without strand breakage. Preferably, multiple layers are used. However, the material of layer 13 is stronger than that of layer 12, and it is preferably impervious to weather and rain in particular. In the preferred embodiment, layer 13 comprises a double layer of a woven synthetic material such as polypropylene.

Layer 14 is also formed from a weather impervious woven material such as polypropylene, and may be of the same strength and weight as layer 13. Layer 14 has a length or vertical dimension that approximates that of layers 12 and 13, but its width is greater, permitting it to be formed into three aligned or parallel compartment or pocket defining portions 21 with resulting pockets 22. The material of layer 14 is also woven to permit strand separation for arrow entry.

In the preferred embodiment, layers 13 and 14 are formed from woven polypropylene (3.2 ounce) having a tensile strength of 200 pounds (warp) and 130 pounds (fill) and an elongation (percentage) of 17 (warp) and 16 (fill).

Layer 15 comprises a first backing layer to which layer 14 is attached. It is formed from a strong and durable material that is tightly woven to resist arrow pass through, and it has a knit pattern that permits a limited degree of rearward and lateral stretch to absorb arrow energy. Preferably, layer 15 comprises two or more layers of a polyester woven material (e.g., sixteen ounce) that is commonly used for lawn mower catch bags.

If target 11 is employed as a target or backstop for firearm bullets, layer 15 would be formed from kevlar or a similar material such as that used in bullet proof vests.

Layer 16 comprises a second backing layer of material that is of greater strength than the other layers and constructed so as not to yield or permit passage of the arrowhead. Preferably two or more layers are used. The other layers are directly secured to backing member 16, and it therefore functions to define and maintain the shape of target 11. Preferably, layer 16 is a synthetic fabric weave formed from polypropylene. In the preferred embodiment, layer 16 is woven 6.3 ounce propylene with a tensile strength of 300 pounds (warp) and 280 pounds (fill) and elongation (percentage) of 20 (warp) and 16 (fill).

With regard to relative layer size, layers 14 and 15 are approximately the same length. However, the width of layer 14, due to the formation of pocket defining portions 21, is generally about twice the width of layers 12, 13 and 15. Layers 12 and 13 are the same width as layer 15 but of greater length to permit the completed target to be closed by bringing the excess material in the front over the inner pockets to meet with the backing material. In the preferred embodiment, layer 12 is approximately 3–3½ inches longer than layer 15, and layer 13 is about 2–2½ inches longer than layer 15. The layer 16 is relatively larger in both length and width to enable its peripheral edges to be rolled over and sewn to the other layers during assembly, as discussed in further detail below.

Layer 15 serves to define overall target size and to provide stability to the finished target. All other layers are cut in reference to layer 15 to ensure that there is sufficient excess material for the overlapped hems as discussed above. After the target is stuffed, as disclosed below, layer 15 is the portion of the target that holds it to the desired shape, and without layer 15 the pockets of layer 14 would have a tendency to become misshapen after repeated hits.

The number of pocket defining portions 21 of layer 14 varies as a function of overall target size. While the number of pockets 22 may vary, from the practical standpoint the least number of pockets is three. In the embodiment shown, the outside dimensions of target 11 is 22 inches by 22 inches, and each of the three pockets 22 is approximately 7.33 inches in width. The number of pockets varies from 3 pockets in a 22 inch square target to 6 pockets in a 50 inch square target. The height of the pocket generally corresponds to the height of the target, and the width of the pocket varies from about 6 inches to about 8½ inches. These dimensions are not intended to be critical, but rather are exemplary of pocket sizes that can be properly filled with compressed stuffing material to effectively stop arrows. For example, the minimum width of the pockets is practically determined by the capability of the apparatus used to insert and compress the stuffing medium. The minimum pocket width is also limited by the pocket depth (thickness) necessary to stop the arrow given the type of stuffing medium. When using raw, processed cotton, the minimum depth of the pockets is at least about 6 inches. The maximum width of the pockets is also determined by the ability to compress the stuffing medium effectively and to prevent it from being laterally displaced.

In the assembly of the target 11, layer 14 is initially sewn to the layer 15. The thread used in the sewing process must have significant tensile strength because of the degree to which the stuffing medium is compressed, and it must also have a limited degree of stretch to withstand the rigors of multiple arrow hits. In the preferred embodiment, the thread used is polypropylene, although nylon can also be used. Polypropylene is preferred because it is more resistant to ultraviolet light and its degree of stretch is better for a target application.

Layer 14 is sewn to layer 15 along the outer edges or seams indicated at 21*a*, 21*b* as well as the inner seams 21*c*, 21*d* between pockets 22. Preferably, four rows of stitches are placed along each of these seams.

The joined layers 14, 15 are then centered on layer 16, and layers 12, 13 are placed over these assembled layers, also in centered relation to the backing layer 16. Because layer 16 is dimensionally larger than the other layers, its peripheral edges extend beyond the peripheral edges of the other layers.

Figure 2:
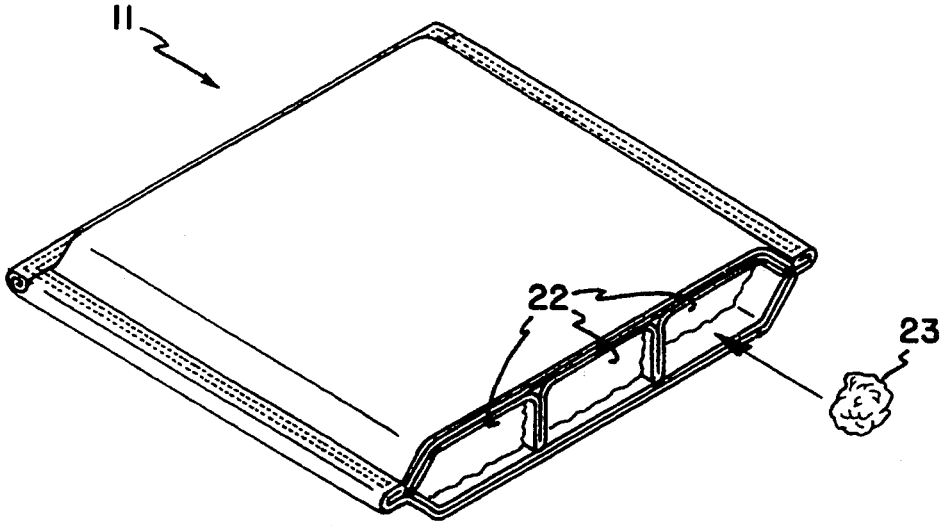
FIG. 2 is a perspective view of an inventive archery target of which manufacture is partially completed.

With reference to FIG. 2, the peripheral edge of backing layer 16 is double rolled over the peripheral edges of the other layers 12–15 along the sides and bottom of target 11, and this composite layer edge is quadruple sewn along each edge. As such, the three pockets 22 are closed at the bottom and open at the top of target 11. It is important that the material of layer 14 be gathered at the extreme bottom end of the pockets 22 so that the pocket does not decrease dimensionally at the bottom end, but rather is of the full cross sectional dimension over substantially the entire pocket length. If the cross sectional size of the pockets 22 decreases in any manner, such decreased areas would have correspondingly less stuffing material and therefore more vulnerable to a pass through.

With continued reference to FIG. 2, stuffing material 23 such as raw, processed (ginned) cotton is stuffed into each of the pockets 22 and highly compressed. As the stuffing material 23 is filled and compressed, the various layers 12–16 are relatively spread apart, and this draws the side edges of target 11 laterally inward so that the cross sectional configuration and size of the three pockets 22 is substantially the same. The purpose of this is to ensure that an arrow striking any place on the front face of the target 11 will encounter the same depth of material and hence will be uniformly stopped.

It will also be observed in FIG. 2 that the side of each of the pocket defining portion 21 is forced into contiguous relation with the side of the adjacent pocket. This eliminates gaps between pockets 22 and also maintains a uniform depth across the width of each of the pockets 22. This ensures that the front face of the target 11 is flat rather than bowed.

While the pockets 22 of the primary embodiment are created by the pocket defining portions 21, the pockets 22 may also be formed by individual envelopes or sleeves of the same or similar material as layer 14, each of which is individually stuffed or packed with stuffing material 23 prior to assembly of the target 11. These individual, self-contained envelopes, which can be of any size and configuration, could be pre-manufactured and maintained in inventory until the time for assembly of the target 11.

Figure 3:
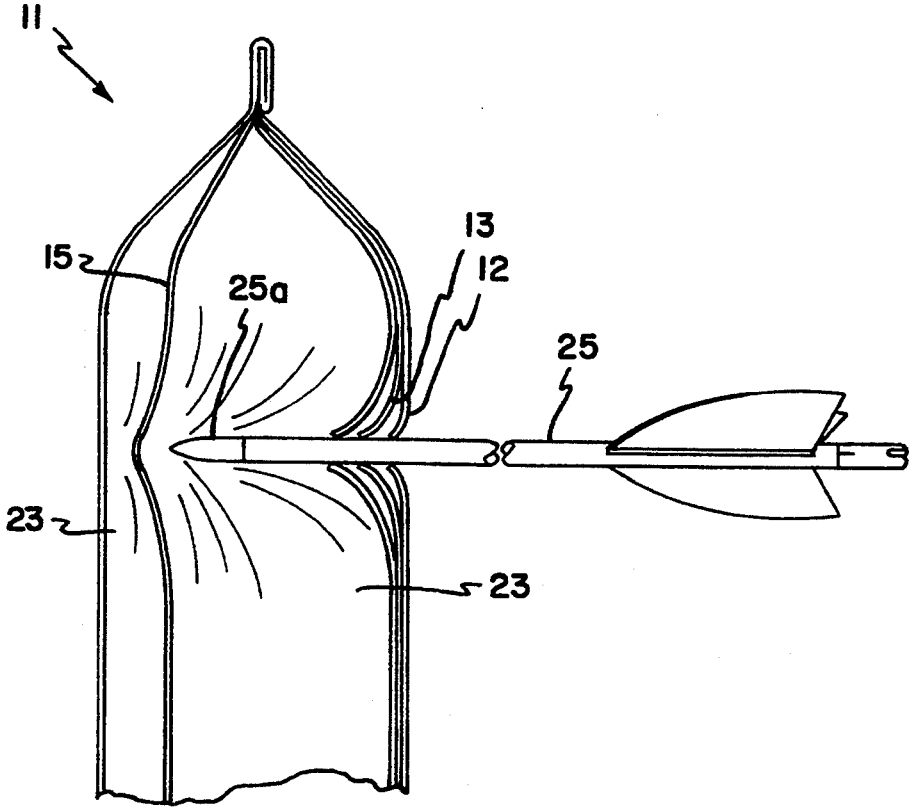
FIG. 3 is an enlarged fragmentary sectional view of the inventive target showing the entry and penetration of an arrow.

In addition to placing the stuffing material 23 into each of the pockets 22, stuffing material 23 is also compressibly forced into the area between layers 15 and 16. As shown in FIG. 3, the presence of stuffing material 23 in this area provides a backing to the pockets 22 and assists in effectively stopping the arrow.

When the stuffing material 23 is completely placed in pockets 22 and between layers 15 and 16, the extended top edge of layer 16 is double rolled onto the other layers, and the assembly is closed with hog rings that are spaced approximately 2 inches apart in the preferred embodiment. Alternatively, the joined layers can be quadruple sewn in the same manner as the side and bottom edges.

The fully assembled target 11 is shown in FIG. 4. A plurality of individual target spots 24 may be removably placed on the front plane or face of target 11. A conventional contact adhesive is preferably used for this purpose, which enables the individual target spots 24 to be easily removed after a series of hits and replaced with a new target spot 24. Alternatively, the use of a single illustrated target sheet may be placed over a greater portion of the front face of target 11.

The use of removable and replaceable target spots is of particular benefit because the archery shooter can move the intended impact point on the target face each time a target spot is replaced, thus extending the life of the target face and the target as a whole.

FIG. 3 indicates the manner in which an arrow 25 is effectively stopped by target 11. The high speed arrow 25 has a sharply pointed arrowhead 25*a* that initially penetrates the facing burlap layers 12 and the double layers 13 and 14 of woven polypropylene. As indicated above, the strands of layers 12, 13 and 14 permit lateral strand movement as the arrowhead 25*a* pierces the target 11, and when the arrow 25 is removed these strands return to their pre-penetration position.

As the arrow 25 enters one of the stuffed pockets 22, it engages the compressed cotton, and because of the long cotton fibers compression immediately begins to occur. This compression tends to force the layer 15 rearwardly, and the material between the tip of arrowhead 25*a* and layer 15 is heavily compressed. This compression rapidly slows the arrow 25 and prevents it from penetrating to the point of engaging the layer 15. The cotton between layers 15 and 16 assists in this regard since it is also compressed.

Although there is some degree of friction between target 11 and the arrow 25, particularly in the layers 12–14, arrow 25 is principally stopped by compression of the cotton. In view of this, removal of the arrow 25 is significantly enhanced, and upon removal the compressed cotton tends to expand back to its original position. If the arrow 26 were stopped by lateral displacement of the stuffing material and friction, it would not be stopped as quickly. Further, the arrow 25 would also be more difficult to withdraw from the target due to the frictional forces created by the laterally displaced stuffing material.

Because of its unique construction, target 11 is much more capable of stopping high speed arrows, even those of carbon/graphite composition. Since the cotton is compressed rather than laterally displaced, it has a much greater tendency to return to its natural position in addition to preventing the arrow from piercing more than the initial layers 12–14. As such, target 11 is capable of withstanding arrow hits to a much greater degree than prior art devices, and its effective life is significantly greater.

As indicated above, target 11 is described in an archery context, but the principles of the inventive target may be applied to stopping firearm bullets as well. There is increasing concern with the amount of lead deposited in the ground resulting from conventional firearm practice. A projectile target employing the inventive principles will not only stop firearm bullets effectively, but will also better hold the bullets for subsequent reclamation, thus reducing any likelihood of ground pollution due to lead.

What is claimed is:

1. A projectile target comprising:

front layer means formed from a woven material having laterally displaceable strands to permit penetration of a projectile;

back layer means formed from material which resists penetration of a projectile;

means defining a plurality of pockets between said front and back layer means; and stuffing material compressibly packed into each of said pockets;

said pockets being sized and configured to substantially resist lateral displacement of said stuffing material and to cause said stuffing material to be compressed forwardly by said projectile.

2. The projective target defined by claim 1, wherein said pockets are disposed in contiguous relation when packed with said stuffing material, whereby projectile movement between adjacent pockets is resisted.

3. The projectile target defined by claim 2, wherein said pockets are of similar configuration and disposed in aligned relation.

4. The projectile target defined by claim 3, wherein said pockets are elongated in configuration and disclosed in substantially parallel relation.

5. The projectile target defined by claim 1, wherein said pocket defining means comprises pocket layer means formed from a woven material having laterally displaceable strands to permit penetration of a projectile, said pocket layer means being sized and configured to form a plurality of adjacent compartments to define said plurality of pockets.

6. The projectile target defined by claim 5, wherein said pocket layer means is formed from woven strands of polypropylene.

7. The projectile target defined by claim 5, wherein said pocket layer means comprises a middle layer of said material disposed between said front and back layer means, said middle layer having a greater transverse dimension than said back layer means and secured thereto to form said plurality of pockets.

8. The projectile target defined by claim 7, wherein said middle layer and said back layer means are of rectangular configuration, the middle layer having a greater width than said backing layer means, and said middle layer being attached to said back layer means along spaced lines that define said pockets therebetween.

9. The projectile target defined by claim 8, wherein said lines of attachment are substantially equidistantly spaced and parallel to define substantially parallel pockets of substantially equal size.

10. The projectile target defined by claim 1, wherein said pocket defining means comprises a plurality of separate, self-contained envelopes each of which forms one of said pockets.

11. The projectile target defined by claim 10, wherein each of said separate envelopes is formed from material having laterally displaceable strands to permit penetration of a projectile.

12. The projectile target defined by claim 10, wherein each of said individual, self-contained envelopes is capable of being individually assembled into said target.

13. The projectile target defined by claim 1 which is rectangular in configuration, said pockets being elongated in configuration and disposed in parallel, contiguous relation.

14. The projectile target defined by claim 1, wherein said front layer means comprises first and second individual front layers.

15. The projectile target defined by claim 14, wherein said first front layer is formed from burlap.

16. The projectile target defined by claim 14, wherein the second front layer is formed from woven strands of polypropylene.

17. The projectile target defined by claim 1, wherein said back layer means comprises first and second individual back layers.

18. The projectile target defined by claim 17, wherein the first back layer is formed from woven strands of polyester.

19. The projectile target defined by claim 17, wherein the first back layer is formed from woven strands of kevlar.

20. The projectile target defined by claim 17, wherein the second back layer is formed from woven strands of polypropylene.

21. The projectile target defined by claim 17, wherein stuffing material is disposed between said first and second back layers.

22. The projectile target defined by claim 1, wherein said stuffing material comprises cotton.

23. The projectile target defined by claim 1, which further comprises at least one target sheet removably secured to the front of said target.

* * * * *